United States Patent [19]

Koivisto et al.

[11] Patent Number: 4,895,624

[45] Date of Patent: Jan. 23, 1990

[54] TURBULENCE GENERATOR MADE OF PLASTIC WITH CERAMIC COATED FLOW DUCTS IN THE HEAD BOX OF A PAPER MACHINE

[75] Inventors: Lasse Koivisto, Varkaus; Heikki Laitinen, Poitsila, both of Finland

[73] Assignee: Valmet-Ahlstrom Oy, Finland

[21] Appl. No.: 199,256

[22] PCT Filed: May 12, 1987

[86] PCT No.: PCT/FI87/00063

§ 371 Date: May 27, 1988

§ 102(e) Date: May 27, 1988

[87] PCT Pub. No.: WO87/06964

PCT Pub. Date: Nov. 19, 1987

[30] Foreign Application Priority Data

May 12, 1986 [FI] Finland ..... 861977

[51] Int. Cl.[4] ..... D21F 1/02

[52] U.S. Cl. ..... 162/343; 162/336

[58] Field of Search ..... 162/336, 343, 344, 216; 428/137, 36

[56] References Cited

U.S. PATENT DOCUMENTS

| | | | |
|---|---|---|---|
| 3,272,233 | 9/1966 | Trufitt | 162/343 |
| 3,725,197 | 4/1973 | Dahl et al. | 162/343 |
| 3,878,039 | 4/1975 | Descary et al. | 162/343 |
| 4,032,683 | 6/1977 | Coale | 428/137 |
| 4,101,699 | 7/1978 | Stine et al. | 428/36 |
| 4,132,820 | 1/1979 | Mitoff | 428/137 |
| 4,146,427 | 3/1979 | Hoget et al. | 162/343 |
| 4,426,257 | 1/1984 | Antikainen et al. | 162/336 |

FOREIGN PATENT DOCUMENTS

| | | |
|---|---|---|
| 1941424 | 2/1971 | Fed. Rep. of Germany . |
| 49441 | 12/1968 | Finland . |
| 63978 | 8/1977 | Finland . |
| 67106 | 7/1984 | Finland . |
| 69330 | 8/1985 | Finland . |
| 8107517 | 7/1982 | Sweden . |
| 8201510 | 10/1982 | Sweden . |

*Primary Examiner*—Karen M. Hastings

*Attorney, Agent, or Firm*—Steinberg & Raskin

[57] ABSTRACT

Turbulence generator for the head box of a paper machine, the quality of the surface of the flow ducts of which has been improved and the manufacturing technique of which is simple. The turbulence generator according to the invention is characterized by the feature that the body of the perforated beams (*6a, 6b*) and the coating material of the face surfaces and the flow ducts are densely and tightly bonded to each other and that the coating materials of the flow ducts (7) is both physically and chemically wear resistant. The body of the beam is plastic, and the surfaces of the flow ducts have a ceramic coating on them.

4 Claims, 2 Drawing Sheets

TURBULENCE GENERATOR MADE OF PLASTIC WITH CERAMIC COATED FLOW DUCTS IN THE HEAD BOX OF A PAPER MACHINE

BACKGROUND OF THE INVENTION

The present invention relates to an improved turbulence generator for the head box of a paper machine. In particular the invention relates to improving the quality of the surface of the flow ducts in the turbulence generator by providing the surfaces of the flow ducts with an appropriate coating.

A turbulence generator according to the invention is intended to be placed, for example, between the distributor and the slice channel of the head box. A turbulence generator is usually employed to create slight turbulence in the pulp flowing onto the wire in order to prevent floc formation, and to smooth pressure and velocity differences in the flow so as to supply an as even flow as possible onto the wire along its whole width.

There is known in the field, for example, a head box as disclosed in Finnish patent No. 49441 according to which pulp flowing onto the wire is guided from the distributor past a rotating perforated roll and through a unit of pipes to the slice channel. The perforated roll is employed in this construction to create turbulence in the pulp and to even out flow differences. This reference already suggests that the pipe unit can be made by welding pipes or plates or by drilling metal or suitable plastics components.

A construction according to Finnish patent No. 63978, for example can be considered as the improvement phase following that disclosed above. In this construction the large quantity of drilled holes is replaced by individual separate cores collected to form a pipe unit of the required size. This construction has become particularly advantageous when the so-called stepped flow ducts disclosed, e.g. in German patent publication No. 19 41 424, have been introduced which aim at improving the turbulence generation in the pulp. The cores disclosed by Finnish patent 63978 are intended to be made of plastics by die casting whereby the stepped flow ducts are also easy to produce. Each core thus comprises only one flow duct and the whole unit of pipes is assembled from a large quantity of cores collected inside a separate body construction.

A third phase in the development of a turbulence generator is a construction disclosed in Finnish patent No. 67106. In this construction the turbulence generator is disposed in the head box between the expansion chamber in the flow duct and the distributor, and between the expansion chamber and the the slice cone. The turbulence generator comprises a perforated plate part made of steel which serves as a load-bearing structural part of the head box. The plastic gap or grate part projects from this perforated plate towards the slice cone and is connected to the perforated plate so as to continue the tubular parts of the gap or grate part as plastic coating of the perforations of the perforated plate and further as coating surface of the side of the perforated plate which is next to the expansion chamber. According to this reference the plastic parts are joined to the perforated plate in connection with the mould casting. The turbulence generator of this publication comprises several parts which form a perforated plate divided in the longitudinal direction and which can be separately disassembled and which are connected to the upper and the lower walls of the head box so as to form a structural entity.

Hitherto the most recent improvement in turbulence generators is disclosed in Finnish patent No. 69330. The turbulence generator of this reference comprises one or several successive perforated plates having conventional flow openings which together with metal pipes constitute several superposed and parallel flow passages. These passages are conical and stepped as also the flow passages in the DE publication No. 19 41 424 mentioned above. Further, the flow passages have been joined by a cast plastic piece to form a unit. According to the reference the mould can serve as a structural supporting part of the head box.

When considering the quality of the pulp suspension flowing onto the wire and the desired economy and the manufacturing technique of a turbulence generator, the prior art devices possess some disadvantages.

The quality of turbulence generators made by drilling only of metal or plastics has been questionable, as all the holes have not been fully parallel or uniform as to the quality of the surface. Also, drilling of all the numerous holes and the surface treatment of the drilled holes, viz. grinding and rounding the edges, takes unreasonably long time and is expensive. Also, the metal pipes used in some applications cause trouble as it is very difficult to get pipes of sufficiently high precision and surface quality and even then they are very expensive. Further, the stepped or conical formation of this kind of pipes increases manufacturing costs.

The third method of manufacturing the pipes either of plastics or by coating a raw metal surface with plastics has not been totally accepted by the users. It has not been possible so far to find a plastics material which would endure all the strain that it is subjected to by the continuous contact with the flowing pulp. The plastic materials available today are to some extent porous and they gradually absorb water which results in swelling of the plastics and the surfaces loose their precision and smoothness. The surface coating can even be detached from the metal which has even more serious consequences. Further, the plastics should endure the great pH changes of the pulp (at least 4 to 8) and the effect of various chemicals such as bleaching wastes, pulp adhesives, retention chemicals, fillers, etc. In addition to the chemical effect, some of these substances also have a physical impact on the plastics surface, i.e. they tend to scratch the surface.

The problems of the devices discussed above are various. In most cases the structure is complex and requires high accuracy in manufacturing. Sometimes the materials do not endure the abrasive impact of the pulp. In all cases the manufacturing costs of the turbulence generator are high.

An apparatus avoiding the disadvantages discussed above should be simple as to its manufacturing technique which should allow manufacturing with adequate precision a construction meeting the most varying requirements. The materials of the apparatus should be both physically and chemically durable and the material constituting the flow surfaces should be already formed in the manufacturing phase, i.e. without a finishing treatment, surfaces of the required form and smoothness.

SUMMARY OF THE INVENTION

The turbulence generator construction for the head box of a paper machine according to the present invention eliminates the disadvantages and limitations of the prior art apparatus discussed above. The turbulence generator according to the present invention is characterized in that the perforated beams constituting the turbulence generator are made of two or more synthetic components bonded chemically to each other to form a unit.

BRIEF DESCRIPTION OF THE DRAWINGS

The turbulence generator according to the invention is described further below, by way of example, with reference to the accompanying drawings, in which.

DESCRIPTION OF THE PREFERRED EMBODIMENT

Figure 1:
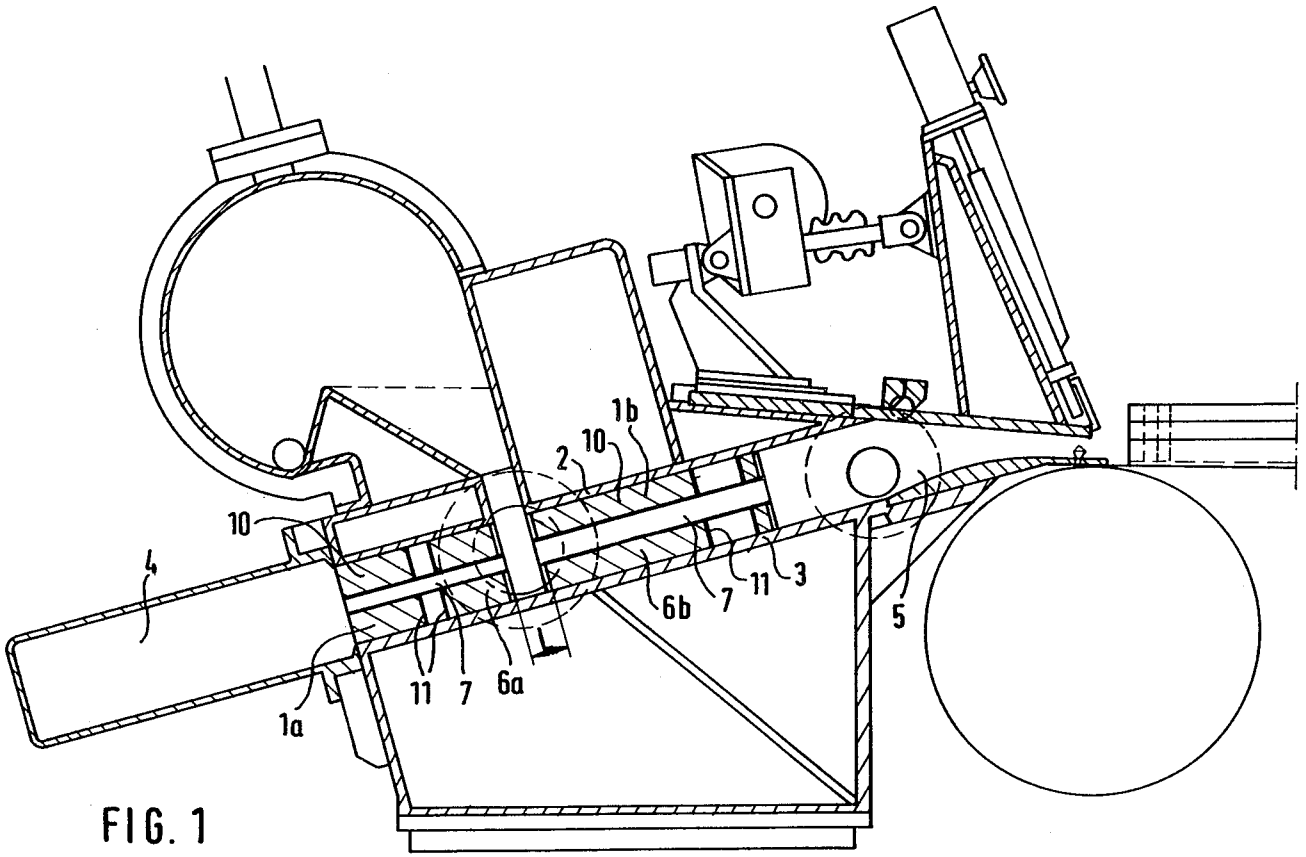
FIG. 1 is general cross sectional view of the position of a turbulence generator in the head box of a paper machine.

In FIG. 1 turbulence generators 1*a* and 1*b* are positioned between an upper wall 2 and a lower wall 3 of the head box of a paper machine in such a way that the pulp suspension flows from a cross head or distributor 4 through the turbulence generators 1*a* and 1*b* to a slice channel 5 of the head box and onto a wire or between wires to the forming part of the paper machine; an expansion chamber being provided in known manner. The turbulence generators 1*a* and 1*b* are formed by one or more apertured or perforated beams 6*a* and 6*b* which have been joined together either mechanically, by bonding, by casting or by any other method which is characteristic to the materials. The turbulence generator can be divided into the perforated beam either in a direction transverse to the longitudinal direction of the generator, as FIG. 1 illustrates, or in another plane, for example, parallel with the axis of the flow ducts 7. As the figure illustrates, the perforated beam shows a plurality of superposed and parallel flow ducts 7, through which the pulp suspension is guided to the slice channel.

Figure 2:
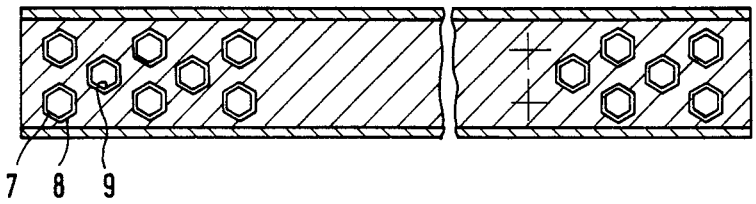
FIG. 2 is a cross sectional view of a preferred embodiment of the turbulence generator.

FIG. 2 illustrates a sectional view of a preferred embodiment of the invention, in which walls 8 of the flow ducts 7 and face surfaces 9 which are in contact with the pulp are made of a synthetic or ceramic material well suitable for this purpose and forms a hard, smooth and dense surface. Preferably the material is fine ceramic or epoxy plastic. Fine ceramic materials mean in this context inorganic, non-metallic substances which have been fused solid by heating, as is defined in the Report no. 17/1984 of the Report Series of Industrial Secretaries on fine ceramics in mechanical structures. The portions 10 between the walls 8 (FIG. 1) are preferably cast of a suitable plastic material such as polyurethane. In other words, the coating material 6 of the flow ducts 7 and/or the face surfaces 9 are formed of plastic material. During casting, reinforcing metal or corresponding other elements (FIG. 1) may have been included in the cast whereby the perforated beams are firm and the upper and the lower part of the head box can be joined to each other. The perforated beam 6 is self-supporting as such without the need to have a perforated metal plate by the distributor 4; attaching a metal plate to the beam would create part of the problems which arise when plastics are attached to metal. The basic principle of an apparatus according to the present invention is the chemical bond of the surface material of the flow ducts to the other raw material of the perforated beam, whereby the depth and the strength of the bond is reliable. Therefore, the bodies of the perforated beams 6*a*, 6*b* and the coating 8 of the surfaces 9 constitute a united entity of at least two synthetic and/or ceramic materials, which are tightly bonded to each other.

Another other embodiment of the invention makes use of the porosity of the outer surface of the coating material of the flow ducts; the filler penetrates into these pores and creates a tight bond. In other words, the synthetic material constituting at least a part of the body of the perforated beams 6*a*, 6*b* is tightly bonded to the pores of the outer surface of the coating material 8. Here it is possible that tubes, which have been manufactured separately, serve as the flow ducts. In this case the tubes are supported during manufacture of the turbulence generator between the end plates of the mould and the filler is cast in the spaces between the tubes.

In some cases it may be advantageous to provide a third layer of different material between the surface material of the flow ducts and the material filling the intermediate spaces.

The turbulence generator according to the invention may be made, for example, in a mould which at first comprises two opposite plates having perforations at the same intervals as there are flow ducts in the turbulence generator to be made. Cores, the thickness and shape of which correspond to the desired size and shape of the flow ducts, are placed into the perforations between the plates. After this, the surface material of the flow ducts and the face surfaces is, for example, sprayed onto the inner surfaces of the mould to form an even layer. After the surface material has solidified, the end and the bottom plates are added and the filler is cast, into which, as previously stated, reinforcing elements may be added if needed.

The embodiment described above is only one preferred embodiment of the turbulence generator according to the invention and an advantageous way of manufacturing the turbulence generator. For example only two manufacturing materials are mentioned as it is almost impossible to gather a list covering all the possible materials. Thus the above is not intended to limit the scope of the invention.

We claim:

1. In a headbox of a paper machine, a turbulence generator comprising at least one perforated or apertured plastic beam having a plurality of flow ducts through which pulp suspension is to be passed, said beam comprising surfaces defining said ducts passing therethrough and having a ceramic coating thereon, wherein said ceramic surface coating and at least a part of a body of said plastic beam are chemically bonded to one another, to constitute a united entity.

2. The combination of claim 1, comprising a plurality of perforated or apertured beams.

3. The combination of claim 1, wherein said turbulence generator is arranged between a distributor and a slice channel of the head box, whereby the pulp suspension is discharged from the slice channel onto a wire or between wires of a forming part of the paper machine.

4. The combination of claim 1, wherein said plastic body is tightly bonded to pores in an outer surface of said ceramic coating.

* * * * *